United States Patent [19]

Morokuma et al.

[11] 4,134,664

[45] Jan. 16, 1979

[54] METHOD OF AND APPARATUS FOR MONITORING HOT DEVELOPING TREATMENT

[75] Inventors: Tadashi Morokuma; Kenichi Oinoue, both of Tokyo, Japan

[73] Assignee: Olympus Optical Co. Ltd., Tokyo, Japan

[21] Appl. No.: 807,340

[22] Filed: Jun. 16, 1977

[30] Foreign Application Priority Data

Sep. 24, 1976 [JP] Japan ..... 51-113757

[51] Int. Cl.[2] ..... H05B 1/00

[52] U.S. Cl. ..... 354/298; 354/299; 219/216; 96/48 HD

[58] Field of Search ..... 354/297, 298, 299; 356/202; 250/316, 571; 219/216, 388; 355/27, 100; 96/48 HD

[56] References Cited

U.S. PATENT DOCUMENTS

| | | | |
|---|---|---|---|
| 3,680,463 | 8/1972 | Attridge et al. | 354/298 |
| 3,826,896 | 7/1974 | Thompson | 219/388 |
| 3,887,787 | 6/1975 | Gregg | 219/216 |
| 4,039,770 | 8/1977 | Johnson et al. | 219/216 |

*Primary Examiner*—L. T. Hix
*Assistant Examiner*—Alan Mathews
*Attorney, Agent, or Firm*—Haseltine, Lake & Waters

[57] ABSTRACT

A method of monitoring a hot developing treatment which can check a hot developed condition of a film used for a hot developing process is disclosed. At least one portion of those image regions of the film which are simultaneously hot developed by a hot developing heating body is used to photoelectrically monitor the developed concentration of said portion and stop the hot developing treatment when the developed concentration of said portion reaches to a predetermined concentration. An apparatus for carrying out the method is also disclosed.

10 Claims, 8 Drawing Figures

METHOD OF AND APPARATUS FOR MONITORING HOT DEVELOPING TREATMENT

This invention relates to a method of and apparatus for monitoring hot development which can check a hot developed condition of a film used for a hot developing process.

As the film used for the hot developing process, a dry silver film, etc. has been well known. In the case of hot developing such film by means of the hot developing process, heretofore it has been the common practice to bring a heating body kept at a constant temperature into contact with the back surface of the exposed film for a suitable time to produce a visible color. The dry silver film is developed under a given temperature of 126° C. for 10 to 20 seconds. The developed concentration of the film is sharply dependent on the temperature of the heating body, so that the temperature of the heating body must be carefully controlled. But, the change in the ambient temperature or the number of developments causes heat delivered from the heating body to change from time to time. As a result, the thermal capacity of the heating body renders its temperature control extremely difficult. In addition, in the case of taking a photograph of an object by means of the dry silver film, if deterioration, etc. of a light source causes the brightness of a light emitted from the light source and for illuminating the object to be photographed to change, the exposed film does not produce a correct visible color even though the hot development is effected at a correct temperature for a correct time.

As described above, even though the photography and hot development are effected under a constant condition, the condition of the film and heating body becomes changed in different manner.

As a result, it is extremely difficult to always obtain a film under a correct condition if the film is subjected to a conventional process of exposing and photographing it.

An object of the invention, therefore, is to provide a method of and apparatus for monitoring hot development which can eliminate the above mentioned disadvantage, which can monitor the developed concentration of a film during its hot development so as to stop the hot developing treatment when the film produces a visible color having a correct developed concentration, and which can always obtain the film under a correct condition.

The invention will now be described in greater detail with reference to the accompanying drawings, wherein.

Figure 1:
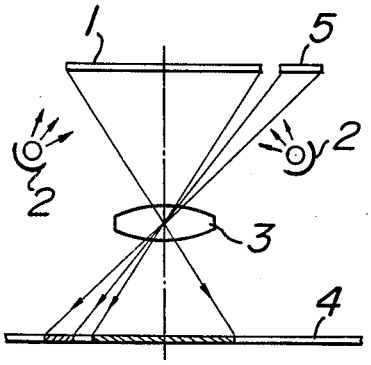
FIG. 1 is a schematic view of an optical system for taking a photograph of an object and reflecting plate on a hot development film.

In FIG. 1 is shown an optical system for taking a photograph of an object on a film used for a hot developing treatment (hereinafter will be called as a hot development film). The optical system is of one which can take a photograph of an object 1 such as a printed matter, etc. on a microfilm.

Reference numeral 2 designates a light source such as a discharge flash tube, etc., 3 shows a photographic lens, and 4 illustrates a hot development film such as a dry silver film, etc. Reference numeral 5 designates a reflecting plate disposed on a plane which is aligned with the object 1 to be photographed. The reflecting plate 5 has a reflecting power used by personnel as a standard to monitor the developed concentration of the film 4 during the developing treatment.

In the case of taking a photograph by means of the optical system shown in FIG. 1, the object 1 to be photographed is fixed on a plane aligned with the reflecting plate 5 and illuminated from the light source 2 in an instantaneous or continuous manner. A shutter (not shown) is made open to expose the film 4 to a given amount of light transmitted through the photographic lens 3.

Figure 2:
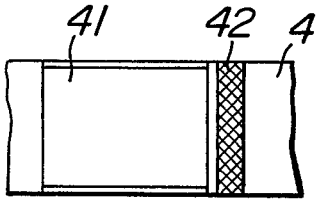
FIG. 2 is a schematic plan view of the photographed film showing a relation between an object image portion and a reflecting plate image portion.

In FIG. 2 is shown a photographed film. On the film 4 are produced an image portion 41 of the object 1 to be photographed and an image portion 42 of the reflecting plate 5 side by side. The reflecting plate image produced on the portion 42 is of one of the photographed reflecting plate 5 which is always the same irrespective of any change of the object 1 to be photograph and constitutes a standard when a photograph of the object is taken.

The photographed film 4 is then transferred to a hot developing device.

Figure 3:
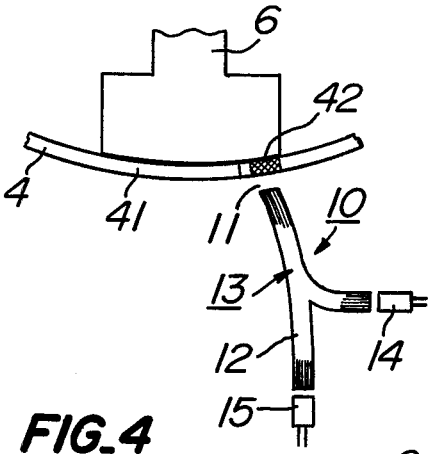
FIG. 3 is a schematic view of one embodiment of an apparatus for monitoring a hot developing treatment according to the invention.

In FIG. 3 is shown one embodiment of an apparatus for monitoring a hot developing treatment according to the invention. Reference numeral 6 designates a hot developing heating body and 10 shows an assembly composed of an illumination means and a photoelectric conversion means.

The assembly 10 is composed of an optical fiber 13 having one end 11 assembled together into one bundle and another end 12 divided into two bundles, a light emitting element 14 opposed to one of the two divided bundles and a light receiving element 15 opposed to the other of the two divided bundles. The one end 11 of the optical fiber 13 is opposed to and spaced apart from the reflecting plate image portion 42 of the film 4 by a given distance. The heating body 6 is brought into contact with both the object image portion 41 and the reflecting plate image portion 42 of the film 4. That portion of the film 4 which is developed by the heating body 6 has an area which is sufficient to at least simultaneously develope both the object image portion 41 and the reflecting plate image portion 42 on the film 4.

The heating body 6 is formed of a material having a high reflecting power such as aluminum. That surface of te heating body 6 which makes contact with the film 4 is sufficiently polished so as to make irregular reflection effect small.

The light emitting element 14 of the assembly 10 has a spectroscopic characteristic in a region which is not sensitive to the film 4.

A method of obtaining a film which is developed under a correct condition will now be described. The film 4 on which both the object 1 to be photographed and the reflecting plate 5 are simultaneously photographed is transferred to the hot developing device shown in FIG. 3 and the photographed portion of the film 4 is fixed to the heating body 6. a control circuit including a heating body driving circuit 16 shown in FIG. 4 and arranged at the back of the film 4 is operated to drive the heating body 6 so as to bring it into contact with the film 4 and start the hot developing treatment. At the same time, a light emitting element control circuit 17 is operated to cause the light emitting element 14 to emit a light. In the hot developing step, the film 4 immediately after starting of the developing step is transparent, so that the light emitted from one end 11 of the optical fiber 13 is transmitted through the film 4 and reflected by the bottom surface of the heating body 6. The light reflected by the bottom surface of the heating body 6 is delivered toward the film 4 and transmitted therethrough again and then incident on the one end 11 of the optical fiber 13.

The incident light is transmitted through one of the branches of the optical fiber 13 to the light receiving element 15 which functions to convert the light into an electric signal which is then amplified by an amplifier circuit 18. The signal thus amplified is supplied to a threshold discrimination circuit 19 which functions to compare the concentration of the visible colors developed in the film 4 with a given threshold concentration value. If the hot developing treatment advances, a light transmittivity of the film 4 is decreased to lower the amount of light incident on the light receiving element 15.

The threshold discrimination circuit 19 functions to detect a time at which the film 4 produces a visible color with a correct concentration, that is, the film 4 reaches to its threshold value and deliver a signal.

The signal delivered from the threshold discrimination circuit 19 causes the heating body driving circuit 16 to operate so as to separate the heating body 6 from the film 4, thereby stopping the hot developing treatment and rendering the hot developing device inoperative.

Figure 5:
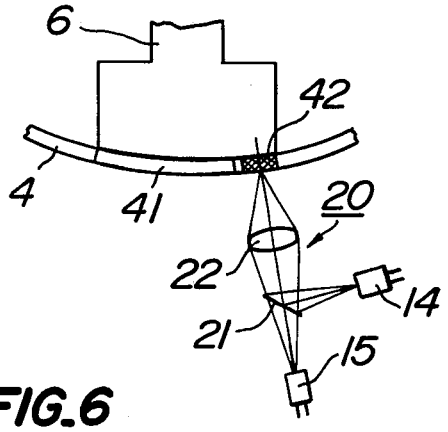
FIG. 5 is a schematic view of another embodiment of an apparatus for monitoring a hot developing treatment according to the invention.

In FIG. 5 is shown another embodiment of an apparatus for monitoring hot developing treatment according to the invention. In the present embodiment, reference numeral 20 designates an assembly of an illumination means and a photoelectric conversion means.

An illumination light emitted from the light emitting element 14 is reflectd by a half mirror 21 and the reflected light is transferred into a point near the film 4 made contact with the heating body 6 by means of a condenser lens 22.

The light reflected by the heating body 6 is transferred through the condenser lens 22 and half mirror 21 into a point on the light receiving element 15. In this case, the condenser lens 22 must be separated from the heating body 6 located at the developing position by a given distance. At both the illumination side and the light receiving side may be arranged an individual condenser lens. In such a case, the illumination may be effected in an inclined direction and the reflected light may be transferred to the light receiving element. In the previous embodiments, the light emitting element 14 is used as the illumination light source, but any other light source for emitting light insensitive to the film 4 may also be used.

As stated hereinbefore, in accordance with the invention, when a photograph of an object is taken on a film, a reflecting plate under the same condition as the object is photographed on the film and both an object image portion and a reflecting plate image portion are hot developed while monitoring the concentration of the reflecting plate image portion, and as a result, it is always possible to obtain a correctly developed film in a simple manner.

Figure 6:
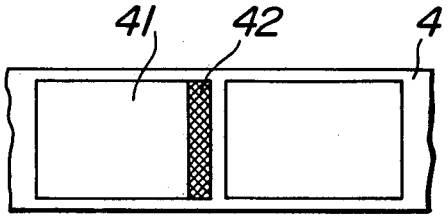
FIG. 6 is a schematic plan view similar to FIG. 2 showing a reflecting plate image portion provided at a marginal edge of one frame on the film.

In FIG. 6 is shown an object image portion 41 provided at its marginal edge with a reflecting image portion 42.

Figure 7:
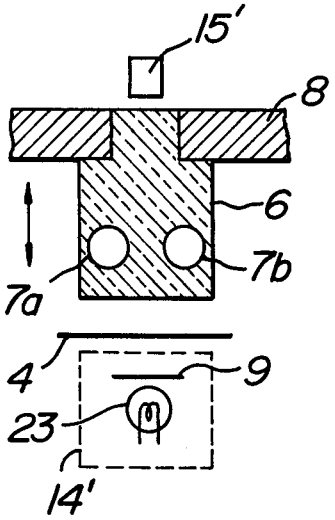
FIG. 7 is a schematic view of a further embodiment of an apparatus for monitoring a hot developing treatment according to the invention.

In FIG. 7 is shown a further embodiment of an apparatus for monitoring a hot developing treatment according to the invention. In the present embodiment, an exposed hot development film 4 is opposed to a transparent heating body 6. The heating body 6 is provided therein with a heat generating source *7a*, *7b* such as an electric power type resistor and functions to heat the film 4 at a temperature of a range which does not remarkably deteriorate the characteristic of the film 4. The heating body 6 may preferably be formed of a material having an excellent heat resistant property, non-heat deformable property and heat conductivity such, for example, as quartz. In addition, the heating body 6 is supported by a holder 8 having an excellent adiabatic effect such that the heating body 6 is vertically movable together with the holder 8. Both the heating body 6 and the holder 8 are made lowered down to bring the lower surface of the heating body 6 into contact with the film 4 so as to subject it to the hot developing treatment.

In the present embodiment, during the hot developing treatment of the film 4, a light having a wave length insensitive to the film 4 is emitted from a light emitting element 14' to the film 4. The light transmitted through the film 4 and the heating body 6 is detected by a light receiving element 15' so as to detect the developed concentration of the film 4. If the developed concentration of the film 4 exceeds a predetermined threshold value, the heating body 6 is raised up and separated from the film 4 thus terminating the hot developing treatment of the film 1.

For this purpose, a light source 23 of the light emitting element 14' is arranged in opposition to the lower surface of the heating body 6 with the film 4 interposed therebetween. Between the film 4 and the light source 23 is arranged a filter 9 and the light receiving element 15' is arranged above the heating body 6. The light emitted from the light source 23 is passed through the filter 9 and heating body 6 and incident upon the light receiving element 15' which functions to detect the developed concentration of the light as described with reference to FIG. 4.

The filter 9 functions to interrrupt that region of the light emitted from the light source 23 which is sensitive to the film 4. The light receiving element 15' is sensitive to that light which lies out of the spectral sensitivity curve of the film 4 and may be formed of a conventional photodiode, photomultiplier, etc.

Figure 4:
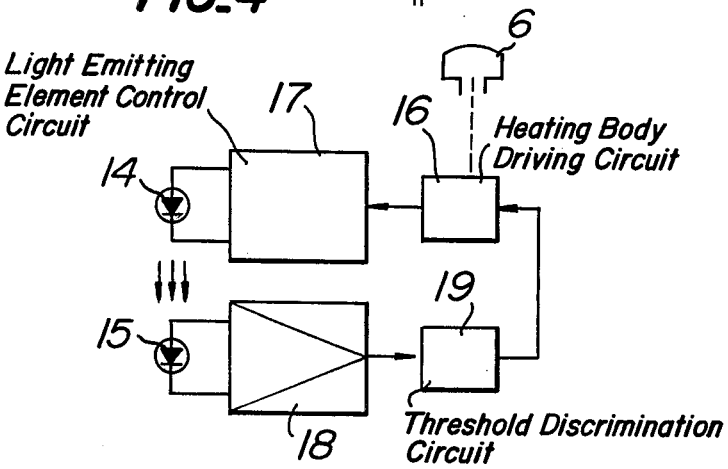
FIG. 4 is a block diagram of a control circuit of the apparatus shown in FIG. 3.

In the present embodiment, the hot developing treatment is effected while monitoring the developed concentration of the film 4 by means of the light receiving element 15' and the control circuit shown in FIG. 4. As a result, it is not necessary to provide a special temperature control device which has been required for the conventional hot developing device and a desired developing treatment can be effected irrespective of the condition of film when it is exposed and photographed. That is, it is sufficient to control the temperature of the heating body 2 in response to a temperature at which a film base is melted or to a temperature at which excessively heavy fog is produced on the film or to a temperature at which the film does not produce a visible color. For this purpose, the heat generating source *7a*, *7b* may be made ON and OFF at suitable intervals of time.

In addition, the optical system for detecting the developed concentration of the film 1 may be composed of the light source 23 and the light receiving element 15', so that the apparatus is extremely simple in construction.

Figure 8:
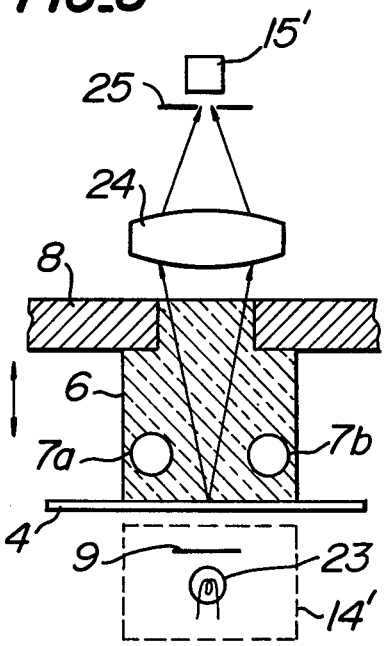
FIG. 8 is a schematic view of a still further embodiment of an apparatus for monitoring a hot developing treatment according to the invention.

In FIG. 8 is shown a still further embodiment of an apparatus for monitoring a hot developing treatment according to the invention. In the present embodiment, the film 4 may be subjected to the hot developing treatment while detecting the developed concentration of a specific position of the hot development film 4. For this purpose, between the heating body 6 and the light receiving element 15' is arranged a lens 24 which can transmit a light having a wave length band required for monitor. The lens 8 functions to produce an image of a specific position of the film 4 through a diaphragm 25 on the light receiving element 15'.

In the present embodiment, the amount of light emitted from the specific position of the film 4 and transmitted through the lens 8 and diaphragm 9 is detected by the light receiving element. If the amount of transmitted light exceeds the predetermined threshold value, the heating body 6 is separated from the film 4. As a result, it is possible to subject the specific position of the film 4 to the hot developing treatment to obtain the desired developed concentration at the specific position of the film 4.

As stated hereinbefore, the present embodiment is capable of developing the hot development film by means of the heating body, detecting the developed concentration of the film by means of the optical system for detecting the developed concentration of the film through the heating body and film while developing the film and terminating the developing treatment when the developed concentration of the film reaches to the given threshold value. The apparatus according to the invention, therefore, has the advantages that a special device for controlling the temperature of the heating body provided for the conventional apparatus is not required and that any desired developed concentration of the film can be obtained by the developing treatment irrespective of the condition of film at the time of exposure and photography.

The invention is not limited to the above described embodiments only and various changes, alternations and modifications may be made. For example, in the above described embodiments, the heating body is made transparent. But, it is not always necessary to make the heating body transparent. The heating body may be formed of a material having a light diffusion property or having a light transmittivity for an electromagnetic wave (for example, infrared ray) having a region insensitive to the film. In the above described embodiments, the light source 23 is arranged at that side of the film 4 which is opposed to the heating body 6 and the light receiving element 15' is arranged at that side of the heating body 6 which is opposed to the film 4. Alternatively, the arrangement of the light source 23 and the light receiving element 15' may be reversed.

What is claimed is:

1. A method for monitoring concentration of a hot developing treatment comprising photoelectrically monitoring a developing image of at least one portion of those image regions of a photographed hot development film which are simultaneously being hot developed by a hot developing heating body while hot developing said regions by said heating body, and stopping said hot developing treatment when the developed concentration of said portion reaches to a predetermined concentration, photoelectrically monitoring a developing image of a reflecting plate image portion of those image regions of said photographed heat development film which are simultaneously being developed by said hot developing heating body while hot developing said regions by said heating body, said photoelectrically monitoring step being carried out with the aid of a light reflected by said heating body, and stopping said hot developing treatment when said reflecting plate image portion produces a visible color having a correct developed concentration.

2. The method according to claim 1 and illuminating said reflecting plate image portion with a light insensitive to said photographed hot development film and photoelectrically monitoring said developed concentration of said portion in response to change in light transmittivity of said portion.

3. The method according to claim 1 and illuminating said reflecting plate image portion with a light insensitive to said photographed hot development film and photoelectrically monitoring said developed concentration of said portion in response to the amount of light reflected by the surface of said heating body through said portion.

4. A method of monitoring concentration of a hot developing treatment comprising photoelectrically monitoring a developing image of at least one portion of those image regions of a photographed hot development film which are simultaneously being hot developed by a hot developing heating body while hot developing said regions by said heating body, and stopping said hot developing treatment when the developed concentration of said portion reaches to a predetermined concentration and photoelectrically monitoring a developed concentration of an overall image region of said photographed hot development film which is hot developed by said hot developing heating body while hot developing said region by said heating body, said monitoring step being carried out with the aid of a light transmitted through said heating body, and stopping said hot developing treatment when said developed concentration of said overall image region reaches to a predetermined concentration.

5. An apparatus for monitoring a hot developing treatment comprising a hot developing device composed of a hot developing heating body brought into contact with a photographed hot development film, an illumination means for illuminating at least one portion of those image regions of said film which are simultaneously hot developed by said heating body while hot developing said regions by said heating body and a photoelectric conversion means for receiving a light emitted from said illumination means and delivering an electric signal, and a control circuit for discriminating said signal delivered from said photoelectric converson means with reference to a given threshold value and stopping said hot developing treatment, said photoelectric converson means receiving a light emitted from said illumination means and reflected by said heating body and delivering said electric signal.

6. Apparatus for monitoring a hot developing treatment comprising a hot developing device composed of a hot developing heating body brought into contact with a photographed hot development film, an illumination means for illuminating at least one portion of those image regions of said film which are simultaneously hot developed by said heating body while hot developing said regions by said heating body and a photoelectric conversion means for receiving a light emitted from said illumination means and delivering an electric signal, and a control circuit for discriminating said signal delivered from said photoelectric conversion means with reference to a given threshold value and stopping said hot developing treatment, said photoelectric conversion means receiving a light emitted from said illumination means and transmitted through said heating body and delivering said electric signal.

7. An apparatus for monitoring a hot developing treatment comprising a hot developing device composed of a hot developing heating body brought into contact with a photographed hot development film, an illumination means for illuminating at least one portion of those image regions of said film which are simultaneously hot developed by said heating body while hot developing said regions by said heating body and a photoelectric conversion means for receiving a light emitted from said illumination means and delivering an electric signal, and a control circuit for discriminating said signal delivered from said photoelectric converson means with reference to a given threshold value and stopping said hot developing treatment, said illumination means being composed of an illumination light source and a condenser lens arranged at a position separated from said heating body by a given distance and for converging a light emitted from said light source into a point near said film which makes contact with said heating body.

8. An apparatus for monitoring a hot developing treatment comprising a hot developing device composed of a hot developing heating body brought into contact with a photographed hot development film, an illumination means for illuminating at least one portion of those image regions of said film which are simultaneously hot developed by said heating body while hot developing said regions by said heating body and a photoelectric conversion means for receiving a light emitted from said illumination means and delivering an electric signal, and a control circuit for discriminating said signal delivered from said photoelectric conversion means with reference to a given threshold value and stopping said hot developing treatment, said photoelectric conversion means receives a light emitted from said illumination means and transmitted through said heating body and said film and delivers said electric signal.

9. The apparatus according to claim 8, wherein said illumination means is composed of a light source and a filter for receiving a light emitted from said light source and interrupting that wavelength region of said light which is sensitive to said film.

10. The apparatus according to claim 8, wherein between said heating body and said photoelectric conversion means are arranged a lens for transmitting that region of said light emitted from said light source, which has a wave length band necessary for monitoring and for producing an image of a specific position of said film through a diaphragm on said photoelectric conversion means.

* * * * *